US005161941A

United States Patent [19]

Ratner

[11] Patent Number: 5,161,941

[45] Date of Patent: Nov. 10, 1992

[54] ACTUATOR ASSEMBLY FOR CONTROLLING INLET AIR FLOW TO CENTRIFUGAL FANS

[75] Inventor: David A. Ratner, Gladstone, Oreg.

[73] Assignee: Sinko Kogyo, Co, Ltd., Japan

[21] Appl. No.: 573,850

[22] Filed: Aug. 28, 1990

[51] Int. Cl.[5] ..... F01D 17/00

[52] U.S. Cl. ..... 415/150; 415/157

[58] Field of Search ..... 415/126, 148, 150, 151, 415/156, 157, 49, 146, 147; 92/98 D, 130 R

[56] References Cited

U.S. PATENT DOCUMENTS

| | | | |
|---|---|---|---|
| 1,703,081 | 2/1929 | Moody . | |
| 1,834,959 | 12/1931 | May . | |
| 2,083,184 | 6/1937 | Anderson . | |
| 2,143,100 | 1/1939 | Anderson . | |
| 2,430,225 | 11/1947 | Hagler . | |
| 2,431,398 | 11/1947 | Hasbrouck . | |
| 2,459,815 | 1/1949 | Hammell . | |
| 2,542,121 | 2/1951 | Earl . | |
| 2,591,118 | 4/1952 | Bent | 92/130 R |
| 3,042,291 | 7/1962 | Greenwald | 415/156 |
| 3,440,946 | 4/1969 | Morrison . | |
| 3,442,220 | 5/1969 | Mottram et al. | 415/156 |
| 3,625,629 | 12/1971 | Morrison et al. . | |
| 3,861,824 | 6/1975 | Sjoqvist et al. . | |
| 4,135,850 | 1/1979 | d'Anjou . | |
| 4,253,796 | 3/1981 | Philipps et al. . | |
| 4,321,008 | 3/1982 | McCoy . | |
| 4,553,404 | 11/1985 | Malchow et al. . | |
| 4,657,481 | 4/1987 | Mowill et al. | 415/151 |
| 4,808,068 | 2/1989 | Asbjornson et al. . | |
| 4,859,140 | 8/1989 | Passadore . | |

FOREIGN PATENT DOCUMENTS

| | | | |
|---|---|---|---|
| 205642 | 10/1959 | Fed. Rep. of Germany . | |
| 2656040 | 12/1975 | Fed. Rep. of Germany . | |
| 0010117 | 1/1983 | Japan | 415/151 |
| 74/4996 | 7/1974 | South Africa . | |
| 113765 | 11/1957 | U.S.S.R. . | |
| 693053 | 10/1979 | U.S.S.R. . | |
| 1006798 | 10/1981 | U.S.S.R. . | |
| 0017391 | of 1911 | United Kingdom | 415/49 |
| 1005555 | 9/1965 | United Kingdom | 92/98 D |
| 1360458 | 10/1971 | United Kingdom . | |
| 1345465 | 6/1972 | United Kingdom . | |
| 1502781 | 10/1974 | United Kingdom . | |
| 2119440 | 3/1983 | United Kingdom . | |

OTHER PUBLICATIONS

"Variscroll" Bulletin 323, Aug. 1983, Aladdin Heating Corporation.

*Primary Examiner*—Edward K. Look
*Assistant Examiner*—Christopher M. Verdier
*Attorney, Agent, or Firm*—Klarquist, Sparkman, Campbell, Leigh, & Whinston

[57] ABSTRACT

An actuator and associated linkage assembly combined to multiply the force applied by the actuator in moving a flow control disk of a centrifugal fan against the air pressure generated by the fan. The actuator includes an internal spring mechanism for closing the disk against the fan air pressure. For some applications the closing force provided by the return spring may be supplemented with an auxiliary spring mechanism that is mounted for providing maximum assistance in closing the control disk, yet not prohibiting the actuator from reopening the disk.

13 Claims, 5 Drawing Sheets

ACTUATOR ASSEMBLY FOR CONTROLLING INLET AIR FLOW TO CENTRIFUGAL FANS

TECHNICAL FIELD

This invention pertains to apparatus for controlling the flow of air through centrifugal fans.

BACKGROUND INFORMATION

Centrifugal fans for commercial applications typically include a fan wheel that is rotated by a constant-speed motor. The fan wheel includes a generally flat, circular back plate and a plurality of spaced-apart blades arranged near the radial edge of the back plate. The blades protrude outwardly from the plane of the back plate. As the back plate is rotated by the motor, the blades rotate about the rotational axis of the fan wheel, which axis is perpendicular to the center of the back plate.

The blades are arranged to define a central cavity within the fan wheel. The blades are shaped and angled so that, as the fan operates, air is drawn into the cavity along a direction generally parallel to the fan wheel rotational axis and forced radially outwardly from the cavity. The fan wheel is contained in a housing that directs the outlet air into the distribution system to which the fan is connected.

A generally frustum-shaped inlet cone is mounted adjacent to the cavity of the fan wheel. The inlet cone is shaped to direct ambient air into the fan wheel cavity in a manner that maintains a substantially laminar air flow stream.

Application requirements for fan systems sometimes specify that the outlet air volume should be variable to match system air volume requirements that vary over time. In this regard, it is usually advantageous to reduce inlet air flow into the fan, whenever the system requirements permit such a reduction, so that the power requirements of the fan motor may be reduced. The power requirements (hence, the operating cost) of the fan motor decrease with the decrease of air flow into the fan wheel. Put another way, reducing the air flow into the fan "unloads" the fan wheel, thereby reducing the load driven by the fan motor.

One known technique for controlling inlet air flow into the fan wheel employs a control disk that is mounted for movement along the rotational axis of the fan. The disk can be moved into a "closed" position against the inlet cone for completely occluding inlet air flow to the cavity of the rotating fan wheel. The disk may be driven away from the inlet cone into a fully "open" position so that the fan wheel is completely exposed to the inlet air flow. The mechanism for moving the disk may be controlled for positioning the disk at any location between the full open and closed positions.

A disk-type inlet air flow control mechanism as just described is disclosed in U.S. Pat. No. 4,808,068, issued to Asbjornson et al. In that patent, the mechanisms described for moving the disk are a motor-driven lead screw arrangement, and a linear actuator/drive screw assembly. Those motor- and lead screw-driven mechanisms are mounted in a manner such that the force that can be applied by the motor or the linear actuator must exceed the maximum force generated by the air pressure acting on the disk as the air is drawn into the cavity of the fan wheel. This force (i.e., the net pressure acting on both sides of the disk) is greatest as the disk approaches the closed position while the fan wheel is rotating. The cost of motors and actuators that have enough power to reliably overcome this maximum force adds a substantial increment to the overall cost of the fan system, especially for applications that require large fan wheels that generate large forces on the control disk.

SUMMARY OF THE INVENTION

This invention is directed to an apparatus for controlling the flow of inlet air to centrifugal fans. The apparatus includes an actuator and an associated linkage assembly that combine to multiply the force applied by the actuator in moving the control disk. As a result, the actuator capacity required for moving the control disk against the fan air pressure is only a fraction of the total force of the air acting on the disk.

As another aspect of this invention, the actuator includes an intenral spring-return mechanism for closing the control disk against the fan air pressure. In many applications, the internal spring force is sufficient, when multiplied by the linkage assembly, to close the disk against the force of the moving air.

As another aspect of this invention, the closing force provided by the internal spring of the actuator is supplemented with an auxiliary spring mechanism. The auxiliary spring mechanism is movably mounted to provide maximum assistance in closing the disk, yet not preventing the actuator from re-opening the disk.

DETAILED DESCRIPTION OF PREFERRED EMBODIMENTS

Figure 1:
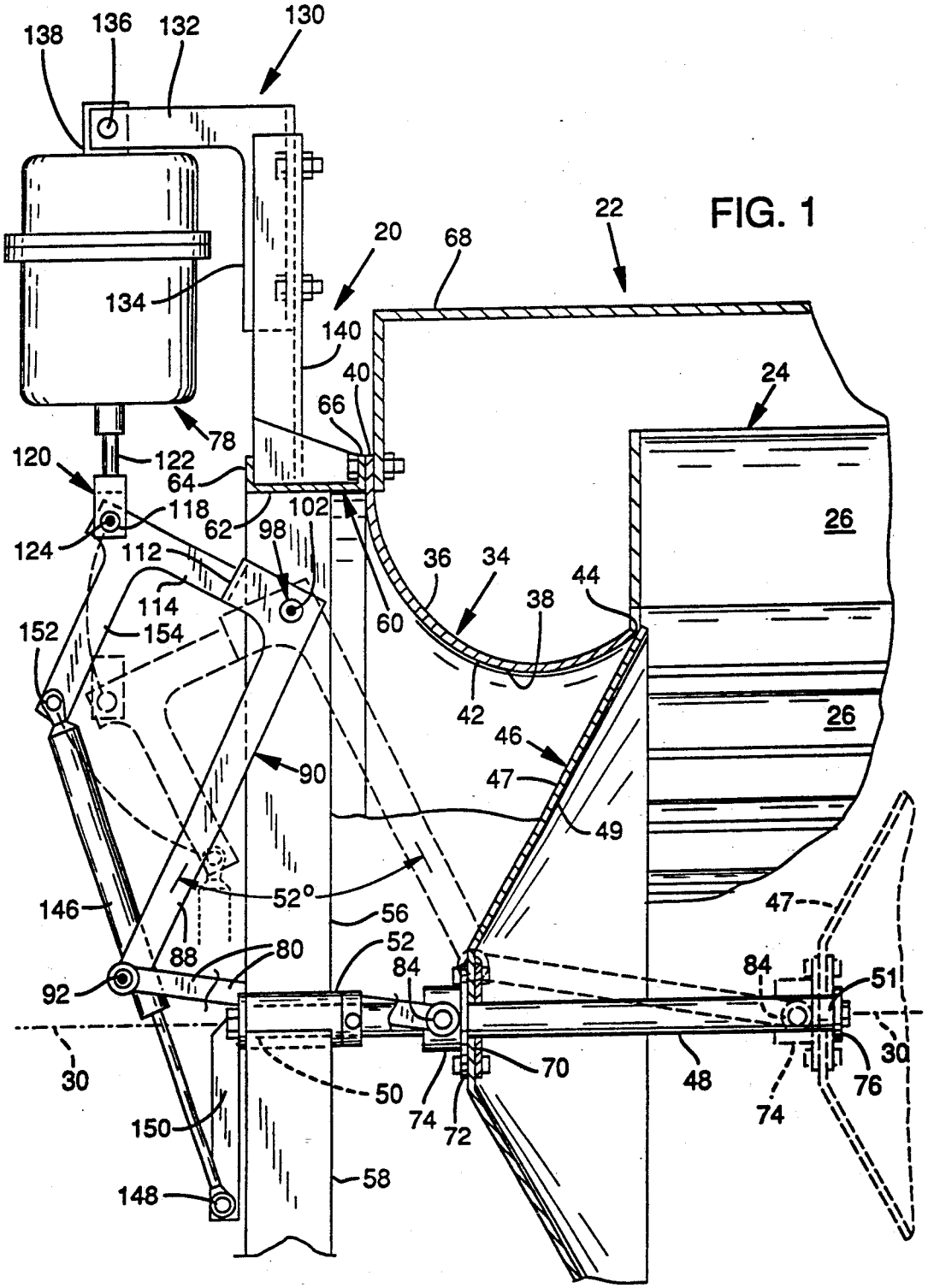
FIG. 1 is a side elevation view, in partial section, of a preferred embodiment of an inlet air control apparatus formed in accordance with the present invention.
Figure 2:
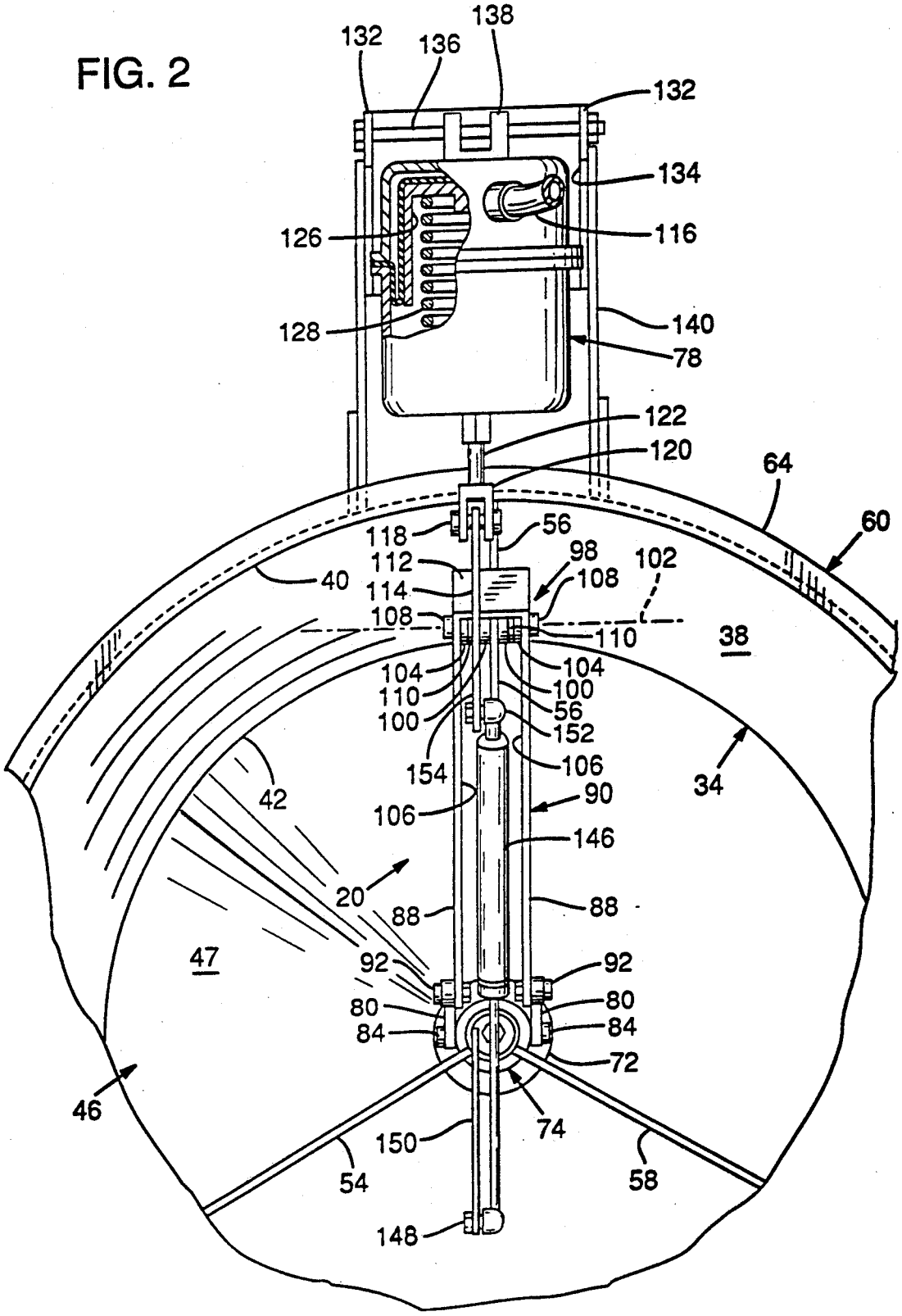
FIG. 2 is a front elevation view of the apparatus of FIG. 1.

As shown in FIGS. 1 and 2, the inlet air flow control apparatus 20 of the present invention is employed with a conventional centrifugal fan 22. The fan 22 includes a fan wheel 24 that has a plurality of blades 26 mounted near the radial edge of the wheel 24. The wheel 24 is driven by a motor (not shown) that rotates the wheel 24 about a central rotational axis 30.

Inlet air is drawn into the fan wheel 24 and is forced radially outwardly by the blades 26. A hollow inlet cone 34 is mounted adjacent to the wheel 24 and has a central axis that is collinear with the rotational axis 30 of the fan wheel 24. The inlet cone 34 is generally frustum-shaped, having a curved wall 36 defining a convex interior surface 38. From the inlet edge 40 of the cone 34, the inside diameter of the cone gradually decreases to a minimum diameter portion or throat 42. The inside diameter of the cone gradually increases from the throat 42 to the outlet edge 44 of the cone 34.

A dish-shaped control disk 46 is slidably mounted to a bearing shaft 48 that is centered along the rotational axis 30 of the fan wheel 24. The disk 46 is movable by hereafter described mechanisms into a closed position (solid lines in FIG. 1) against the outlet edge 44 of the cone 34 to occlude inlet air flow into the fan wheel 24. The disk 46 may also be moved to a full "open" position (dashed lines in FIG. 1), or to any position between the full open and closed position. When the disk is in the fully opened position, the air flow into and out of the fan wheel 24 is substantially unimpded by the disk 46.

The control disk 46 has a central flat portion 70. A central aperture is formed in the flat portion 70 for permitting extension of the bearing shaft 48 through the disk 46. The front surface (i.e., the surface facing left in FIG. 1) of the flat portion 70 is fastened to a flanged end 72 of a hub 74 that is slidable along the shaft 48. A safety stop 76 is fastened to the outer end 51 of the bearing shaft 48 to keep the disk 46 on the shaft 48 in the event the disk breaks from the hub 74.

The outer end 50 of the bearing shaft 48 is secured to a tubular shaft support 52. The shaft support 52 is held in position (i.e., centered along the rotational axis 30 of the fan wheel) by three rigid vanes 54, 56, and 58 that are attached at their inner ends to the shaft support 52. The vanes 54, 56, 58 extend radially from the shaft support 52 and are attached at their outer ends to an annular frame 60 that is mounted to the inlet cone 34.

The annular frame 60 comprises an annular base plate 62 to which is attached a radially protruding front flange 64 and a radially protruding rear flange 66. The frame 60 is secured by fasteners to the inlet edge 40 of the inlet cone 34, and to the housing 68 that encloses the fan wheel 24 (FIG. 1). The annular frame 60 provides support for the inlet air flow control apparatus 20 of the present invention.

The apparatus 20 for moving the disk 46 between the open position and the closed position includes a linkage assembly that is designed to provide mechanical advantage to an actuator 78 that is mounted to the frame 60 and that is operable for opening and closing the control disk 46 against the air pressure that is generated by the rotating fan wheel 24.

Figure 3:
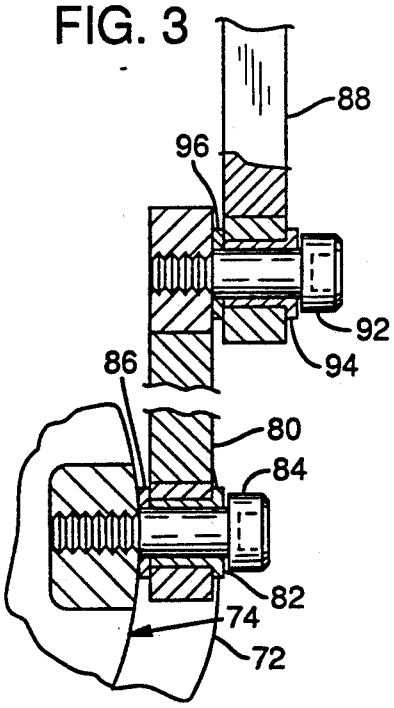
FIG. 3 is a cross-sectional detail view of the pivotal connection of the linkage assembly of the present invention.

The linkage assembly includes a pair of elongated rigid links 80 that are pivotally attached at one end diametrically opposing locations on the hub 74. As shown in FIG. 3, the ends of the links 80 that are attached to the hub 74 each include an aperture in which is seated a flange bearing 82. A shoulder screw 84 passes through the flange bearing 82 and is threaded into the hub 74. An annular thrust bearing 86 surrounds the shoulder screw 84 and is positioned between the hub 74 and the link 80.

Each link end that is away from the hub 74 is pivotally attached to a downwardly depending one of two arms 88 that are part of a rigid actuating member 90. The pivotal connection between the links and the actuating member arms 88 (FIG. 3) includes a shoulder screw 92 that extends through a flange bearing 94 that is seated in an aperture in the lower end of the actuating member arm 88. The end of each shoulder screw 92 is threaded into the end of a link 80, with an annular thrust bearing 96 disposed around the shoulder screw 92 between the link 80 and the arm 88.

The actuating member 90 connects the two links 80 (hence, the control disk 46) to the pneumatic actuator 78 that is mounted to the frame 60. The actuating member 90 is mounted, via a fixed-location pivot assembly 98, to the vertical upper support vane 56. In this regard, the actuating member arms 88 extend in parallel from the lower pivotal connection at the links 80 to the pivot assembly 98 near the top of the frame 60. The upper ends of the arms 88 are connected to the pivot assembly 98.

The pivot assembly 98 comprises a trunnion 100 (FIG. 2) fastened through the center vane 56 to define along the central axis of the trunnion a fixed pivot axis 102 about which the actuating member 90 pivots. Hollow cylindrical spacers 104, centered on the pivot axis 102, are attached to the facing inner surfaces 106 of the arms 88. A shoulder screw 108 extends through each arm 88 and adjacent spacer 104 and is threaded into the between the trunnion 100 and spacer 104. The actuator member 90 is supported by the shoulder screws 108 to pivot about the fixed pivot axis 102.

Near the pivot axis 102, the upper ends of the arms 88 are joined by a flat support plate, 112. A single rigid piece 114 of the actuating member 90 is fastened at one end to the support plate 112. The piece 114 of actuating member 90 protrudes outwardly from the support plate 112 and includes an aperture for receiving the pin 118 of a clevis bracket 120 that is carried on the end of the actuator rod 122 of the above-mentioned actuator 78. The pivotal connection between the rod 122 and piece 114 defines a movable pivot point 124 (FIG. 1), which, upon extension and retraction of the rod 122, rotates about the fixed pivot axis 102.

Preferably, the actuator 78 is a spring-return pneumatic type, configured so that pressurized air delivered to the actuator via a hose 116 is directed against and internal piston 126 for extending (i.e., moving downwardly in FIGS. 1 and 2) the rod 122 against (i.e., compressing) an internal return spring 128 (FIG. 2). Whenever a sufficient amount of air is vented from the actuator 78, the return spring 128 expands to retract the rod 122.

Although a pneumatic spring-return actuator 78 is preferred, it is contemplated that any suitable actuator, such as an electrically driven linear actuator, will suffice for moving the actuating member 90.

The actuator 78 is suspended forward of the fan frame 60 by a generally L-shaped bracket 130 that includes a pair of spaced apart horizontal legs 132, and a vertical leg 134. A pivot rod 136 is fastened between the outermost ends of the horizontal legs 132. A clevis-type pivot bracket 138 is attached to the actuator 78 to receive the pivot rod 136 to that the actuator is pivotally connected to the bracket 130.

The vertical leg 134 of the mounting bracket 130 is fastened to a mounting channel 140 that is attached to the top of the frame 60. Preferably, the mounting bracket 130 is adjustably fastened to the mounting channel 140 to permit changes in the bracket 130 vertical position. Consequently, actuators having varying stroke lengths may be carried by the mounting bracket 130. Moreover, the horizontal legs 132 of the mounting bracket 130 may include several pairs of apertures for placing the pivot rod 136 at a suitable location relative to the mounting channel 140, depending upon the particular configuration of the actuator 78.

Figure 4:
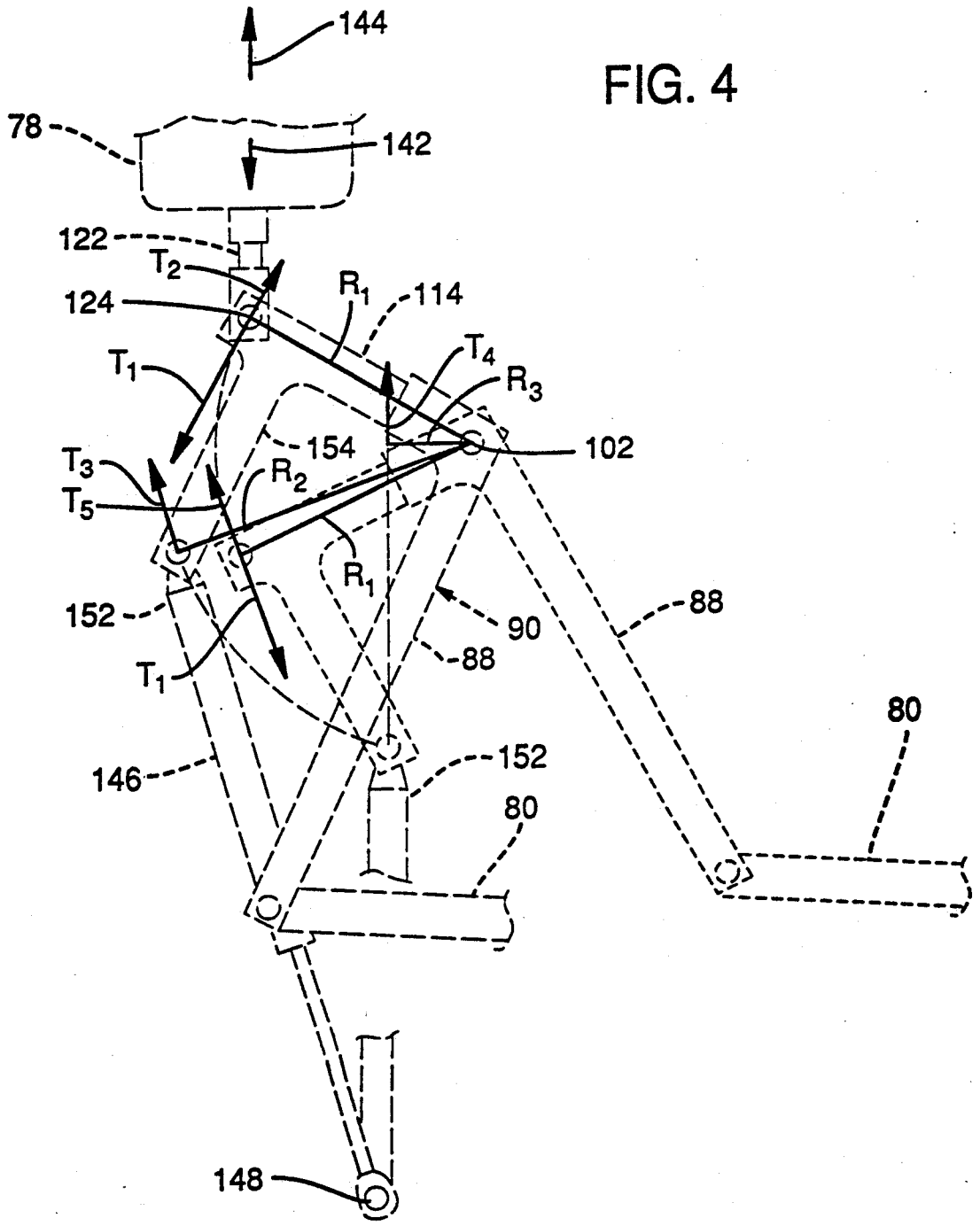
FIG. 4 is a diagram of the torque generated by the apparatus of the present invention.

Referring, in particular, to FIGS. 1 and 4, it can be appreciated that whenever the actuator rod 122 is extended in the direction illustrated by arrow 142 (FIG. 4) there will be applied to the actuating member 90 a torque about pivot axis 102, which torque is transferred via links 80 to a a translational force on the disk 46 for moving the disk toward the open position (i.e., to the right in FIG. 1). The torque applied by the rod 122 is continuously resisted by the torque produced the compressed resisted by the torque produced the compressed internal actuator spring 128 acting in a direction 144 opposite to the rod extension direction 142.

The torque $T_1$ (FIG. 4) applied by the actuator 78 through rod 122 is quantified as the component of the rod force acting at right angles to the moment arm $R_1$, which arm $R_1$ is the distance between pivot axis 102 and pivot point 124. The torque $T_2$ provided by the spring 128 is quantified as the component of the spring force acting a right angles to the moment arm $R_1$, and in a direction opposite that of the rod torque $T_1$. accordingly, the net torque applied by the actuator 78 to the actuating member 90 is the difference between $T_1$ and $T_2$.

Whenever it is desirable to move the disk 46 into the closed position (i.e., to the left in FIG. 1) the pressurized air supplied to the actuator 78 is vented and the net torque acting to close the disk 46 will be (only) the torque $T_2$ provided by the actuator return spring 128. It can be appreciated that the effect of the actuating member 90 configuration is to multiply the force applied by the spring 128 (that is, considering the pivot axis 102 as a fulcrum, and arm $R_1$ as a lever arm) in closing the disk so that, in many applications, the multiplied resilient force of the internal spring 128 is sufficient for closing the control disk 46.

As mentioned earlier, the air pressure acting on the disk is generated by the rotation of the fan wheel 24. As the disk 46 approaches the closed position, the consequent inlet-air flow restriction caused by the proximity of the disk 46 to the cone 34 produces a rapid drop in pressure in the vicinity of the fan wheel 24, which drop creates a significant pressure differential or gradient between the front surface 47 and the rear surface 49 of the disk. In many applications the resultant force of the air on the disk 46 (that force being the product of the pressure differential and the effective area of the disk) may be overcome by the counteracting and multiplied force that is provided by the spring 128. In such an instance, it can be appreciated that the present invention provides an apparatus for controlling the inlet air flow to a fan without the need and expense of powerful motor-driven assemblies.

In instances where the fan size is so large that the resultant force of moving air against the disk 46 cannot be overcome by a suitable spring-return pneumatic actuator, the present invention provides for a simple and inexpensive auxiliary mechanism that provides to the actuating member 90 a very high torque for the purpose of assisting the actuator spring 128 in closing the disk. Moreover, the auxiliary mechanism is mounted so that the torque provided by that mechanism for closing the disk 46 is readily reduced and overcome by the actuator rod 122 as the rod is extended to open the disk to meet the air system volume requirements.

Referring to FIGS. 1, 2 and 4, the auxiliary mechanism preferably comprises a gas-assisted compression spring 146 that is mounted to provide to the actuating member 90 a maximum torque $T_3$ (FIG. 4) to assist in closing the disk 46 against the inlet air. Moreover, the compression spring 146 is mounted so that the torque applied by the spring 146, which torque continuously acts against the net torque $T_1$-$T_2$ that is necessary for opening the disk, gradually decreases as the rod 122 is extended to open the disk. As a result, the net torque $T_1$-$T_2$ provided by the actuator 78 in opening the disk (which torque $T_1$-$T_2$ also gradually decreases as the torque $T_2$ increases as a result of the compression of internal spring 128) remains greater than the torque provided by the compression spring 146 throughout the stroke of the disk rod 122 between the closed and opened position of the disk 46.

The lower end 148 of the compression spring 146 is pivotally mounted to the lower end of an elongated bracket 150. The bracket 150 is fastened at its upper end to the outer end of the shaft support 52 and extends downwardly therefrom.

The upper end 152 of the compression spring 146 is pivotally attached to the lower end of an elongated leg 154 that is part of the actuating member 90. The leg 154 is attached to, and extends in a direction substantially perpendicular to, the extension piece 114 of the member 90. The actuating member leg 154 is sized so that whenever the disk 46 is in a closed position, the end 152 of the compression spring 146 is swung away from the pivot axis 102 to a location where the moment arm $R_2$ (FIG. 4) associated with the compression spring-produced torque $T_3$ is at a maximum for producing a high torque $T_3$ for complementing the torque $T_2$ in closing the disk 46 (FIG. 4).

As the pneumatic actuator 78 is controlled to extend the rod 122, the leg 154 of the actuating member 90 swings the attached upper end 152 of the compression spring 146 to a location where the force applied by the compression spring 146 acts through a relatively short moment arm $R_3$ so that the torque $T_4$ provided by the compression spring 146 when the disk is in the fully opened position is substantially less than the torque $T_3$ applied by the compression spring 146 as the disk moves into the closed position. It will be appreciated by one of ordinary skill in the art that the torque provided by the compression spring 146 gradually decreases from torque $T_3$ to torque $T_4$, even through the force provided by the spring 146 increases as a result of compression of the spring 146 in moving from the closed to the open position.

Whenever the actuator rod 122 is extended to move the disk to the full open position, the net torque applied by the actuator 78 can be quantified as $Th_1$-$T_5$, where $T_5$ is the torque provided by the internal spring 128 in the acutator, which torque $T_5$ acts in a direction opposite to the torque $T_1$ provided by the actuator rod. The torque $T_5$ provided by the spring 128 as the disk moves into the open position is greater than the torque $T_2$ applied by the spring 128 when the disk is in a closed position because the intenral spring 128 is compressed a maximum amount when the rod 122 is extended to the open position. Accordingly, the compressed spring 128 has, in the disk-open position, a maximum resilient force that opposed the force of the extended actuator rod 122. In accordance with the present invention, the compression spring 146 is configured and arranged so that the magnitude of the torque $T_4$ will be slightly less than the magnitude of the net toque $T_1$-$T_5$ so that the pneumatic actuator 78 is able to overcome the torque of the compression spring 146 and move the disk 46 to the full open position.

Figure 5:
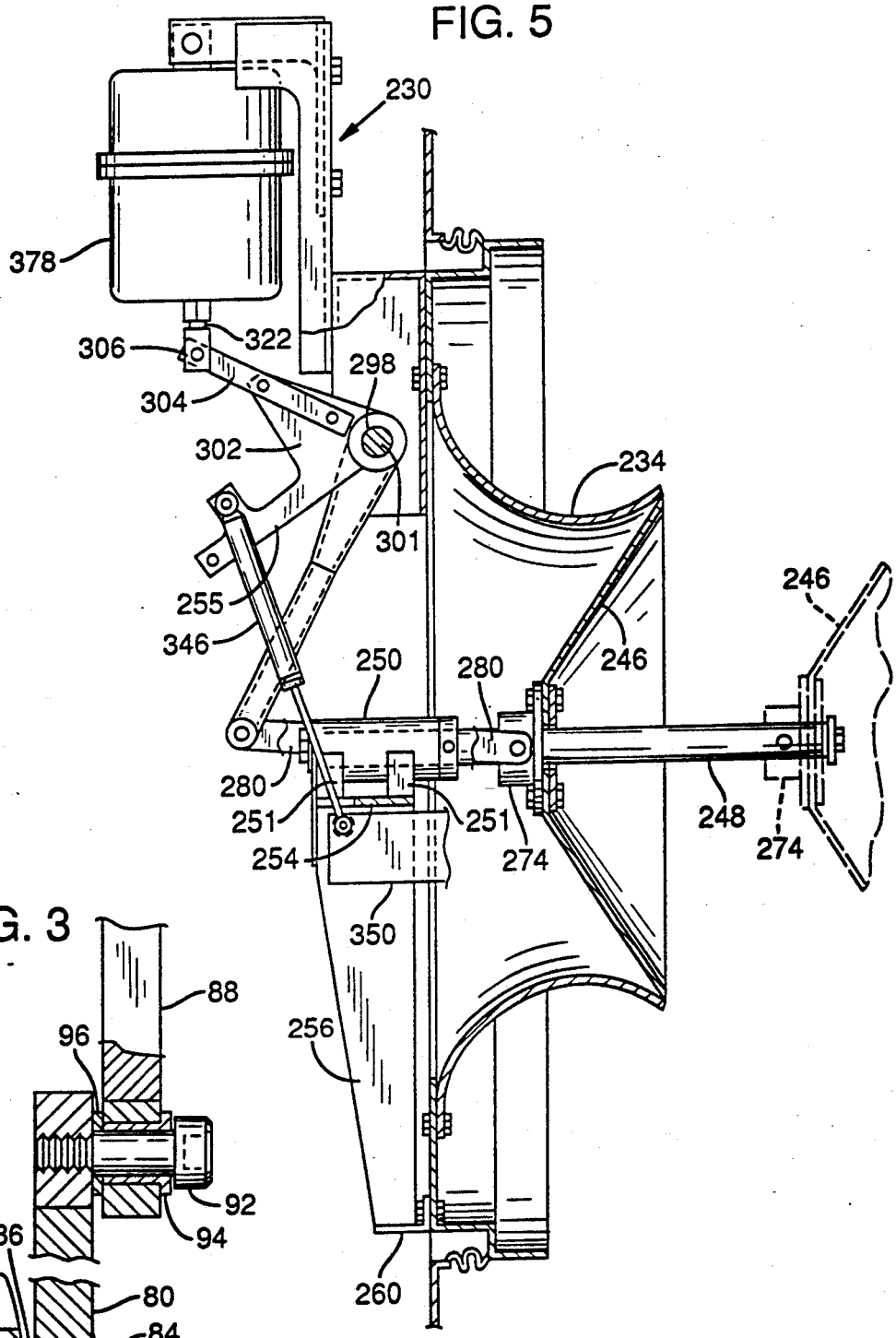
FIG. 5 is a side elevation view, in partial section, of an alternative embodiment of the present invention.
Figure 6:
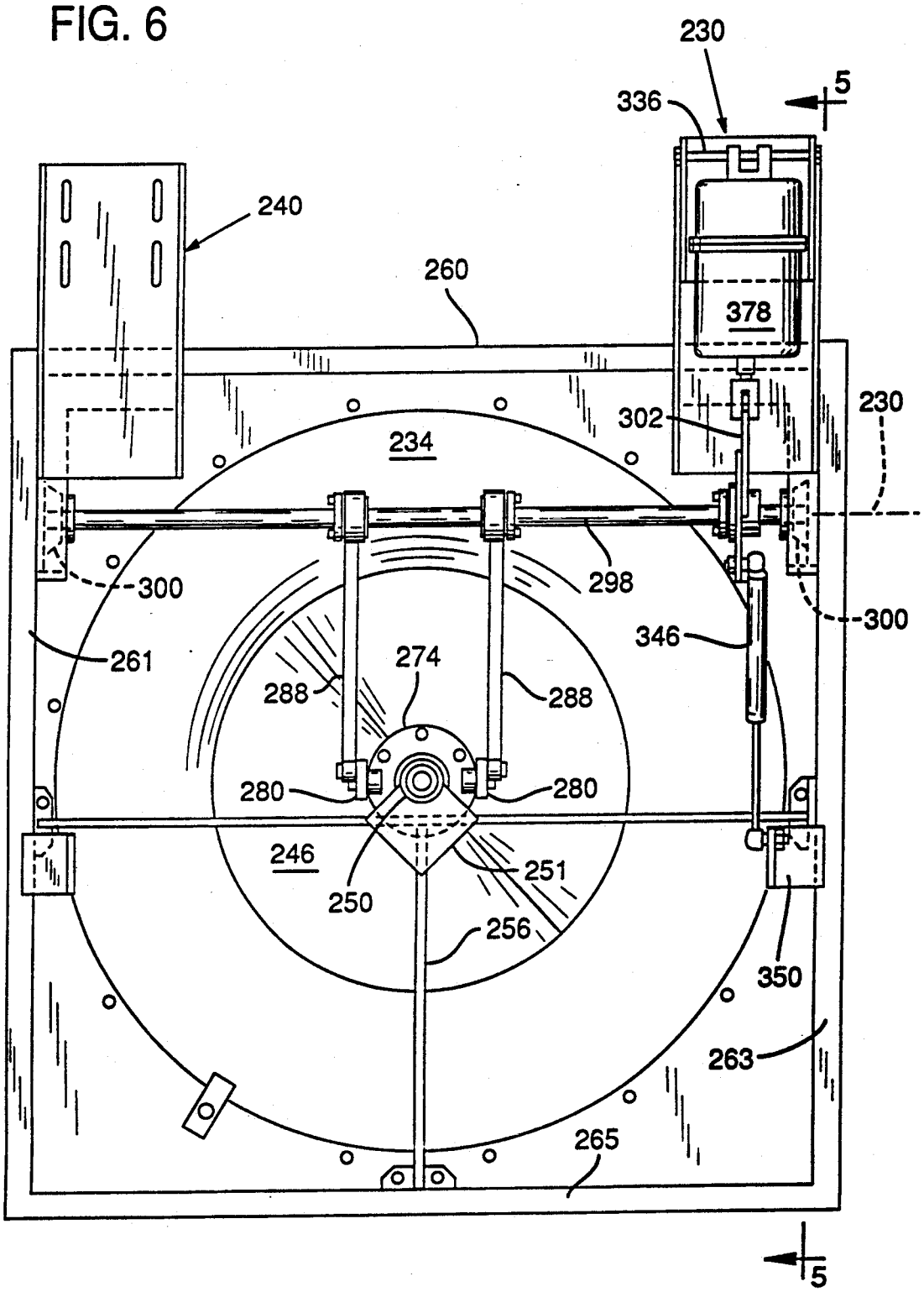
FIG. 6 is a front elevation view of the embodiment of FIG. 5.

FIGS. 5 and 6 depict an alternative embodiment of the present invention for use with very large capacity centrifugal fans. In this embodiment, the inlet cone 234 is fastened to generally rectangular frame 260. The support 250 for the bearing shaft 248 is mounted on a pair rigid plates 251, which are carried by a horizontal vane 254 that extends between the vertical sides 261, 263 of the frame 260. A vertical vane 256 extends upwardly from the bottom 265 of the frame 260 to support the horizontal vane 254.

Links 280 are pivotally attached to a hub 274 that is fastened to the disk 246. Opposing ends of the links 280 are pivotally attached to arms 288 that extend upwardly from the connection with the links 280 to engage an actuator bar 298. The actuator bar 298 is journaled into bearings 300 carried on the opposing sides 261, 263 of the rectangular frame 260. The arms 288 are keyed to the bar 298 so that rotation of the bar 298 about its longitudinal axis 301 forces the arms 288 to pivot about that axis 301 and move the disk 246 between the closed position (solid lines in FIG. 5) and the open position (dashed lines FIG. 5).

An actuating plate 302 is keyed to the bar 298 for rotation therewith about the axis 301 of the bar 298. The actuating plate 302 includes an extension piece 304 that is attached thereto and protrudes outwardly from the actuating plate 302 to terminate in a pivotal connection 306 with an actuating rod 322 of a pneumatic actuator 378. The actuator 378 is carried by a bracket assembly 230 that fastens to one side 263 of the frame 260 and that is constructed to carry the actuator via a pivot pin 336.

The actuating plate 302 includes a lower leg 254 to which is pivotally attached the upper end of a compression spring 346. The lower end of the compression spring 346 is pivotally attached to a bracket 350 that protrudes from the side 263 of rectangular frame 260.

Upon inspection of FIG. 5, it can be appreciated that the arrangement of the actuator bar 298 actuating plate 302, compression spring 346, and actuator 378 will provide the same relative torque relationships as discussed in connection with FIG. 4. Moreover, as is best shown in FIG. 6, the alternative embodiment of the present invention provides a location for mounting a second pneumatic actuator, associated actuator plate, and compression spring for increasing the amount of torque that can be applied to the actuator bar 298 in moving the control disk 246 of an extremely large capacity fan. A portion of a bracket 240 is depicted in FIG. 6 for illustrating the location for mounting the second actuator and associated mechanism just mentioned.

Although the invention has been illustrated and described in terms of preferred and alternative embodiments, it will be apparent to those skilled in the art that changes and modifications may be made without departing from the invention in its broader aspects. Consequently, the appended claims are intended to cover all such changes and modifications as fall within the spirit and scope of the invention.

I claim:

1. An apparatus for controlling a movable fan part that is located in a path of inlet air to a fan, comprising:

an actuating member mounted near the fan part and connected to the fan part and movable for positioning the connected fan part at first and second positions within the path of the fan inlet air, the part being located relative to the fan so that the inlet air urges the part toward the second position, the force of the inlet air on the fan part when the fan part is in the first position being greater than the force of the air on the fan part when the fan part is in the second position;

actuator means for applying actuating force to move the actuating ember, the actuator means including:

a first actuator mechanism operable for applying a first component of the actuating force to the actuating member for moving the part toward the second position, the first actuator mechanism also being operable for removing the first actuating force component;

a second actuator mechanism operable for applying a second component of the actuating force, the second actuating force component substantially continuously resisting the first actuating force component; and a third actuator mechanism operable for applying a third component of the actuating force, the third actuating force component substantially continuously resisting the first actuating force component.

2. The apparatus of claim 1 wherein the second and third actuator mechanism combine to move the fan part to the firs position whenever the first actuating force component is removed.

3. The apparatus of claim 1 wherein the actuating member and the third actuator mechanism are arranged so that the third actuator mechanism applies to the actuating member a torque that continuously decreases as the part is moved from the first to the second position.

4. The apparatus of claim 1 wherein the first, second, and third actuating mechanisms are arranged relative to the actuating member for applying respective first, second, and third torques to the actuating member.

5. The apparatus of claim 1 wherein the actuating member is pivotally mounted to the fan.

6. An apparatus for controlling inlet air flow through an inlet opening to a rotating fan, comprising:

a control member mounted for movement between first and second positions relative to the fan and configured to control the amount of air that may flow to the fan, the size of the opening to the fan whenever the control member is in the first position being less than the size of the opening to the fan whenever the control member is in the second position; and actuator means connected to the control member for moving the control member relative to the fan, the actuator means including first spring means for continuously urging the control member toward the first position and for moving the control member to the first position while the fan rotates, wherein the actuator means includes an actuating member mounted for movement with the control member as the control member moves between the first and second positions, and wherein the first spring means includes a spring attached to the control member, the spring being arranged to provide a torque to the actuating member, the torque increasing as the actuating member moves with the control member toward the first position.

7. The apparatus of claim 6 further comprising second spring means for supplementing the first spring means in urging the control member toward the first position.

8. An apparatus for moving a movable fan part comprising:

an actuating member;

mounting means for mounting the actuating member adjacent to a fan for pivotal movement relative to the fan;

connection means for connecting the actuating member to a fan part that is movable in first and second directions, the actuating member pivoting in a first direction whenever the fan part moves in a first direction, the actuating member pivoting in a second direction whenever the fan part is moved in the second direction, the second direction being substantially opposite the first direction;

an actuator connected at a first location to the actuating member for urging the actuator member to pivot in the first direction; and an elongated auxiliary actuator having one end connected to the actuating member at a second location away from the first location and arranged for urging the actuating member to pivot in the second direction.

9. The apparatus of claim 8 wherein the auxiliary actuator is mounted to apply a magnitude of torque to the actuating member.

10. The apparatus of claim 9 wherein the auxiliary actuator is configured and arranged so that the magnitude of the torque applied to the actuating member changes as the actuating member pivots.

11. The apparatus of claim 10 wherein the auxiliary actuator is a compression spring having one end mounted to the actuating member, the spring and a portion of the actuating member being arranged to define a moment arm, the length of the moment arm changing as the actuating member pivots.

12. The apparatus of claim 11 wherein the actuator is configured so that the force applied by the actuator to the actuating member diminishes as the actuating member pivots in the first direction.

13. The apparatus of claim 12 wherein the spring is mounted so that the length of the moment arm diminishes as the actuating member pivots in the first direction.

* * * * *

UNITED STATES PATENT AND TRADEMARK OFFICE

CERTIFICATE OF CORRECTION

PATENT NO. : 5,161,941

DATED : November 10, 1992

INVENTOR(S) : David A. Ratner

It is certified that error appears in the above-indentified patent and that said Letters Patent is hereby corrected as shown below:

Column 5, line 12, "accordingly" should be --Accordingly--;

Column 6, line 42, "$Th_1$-$T_5$" should be --$T_1$-$T_5$--;

Column 6, line 66, "pair rigid" should be --pair of rigid--;

Column 7, line 24, "254" should be --255--;

Column 7, line 30, "298 actuating" should be --298, actuating--;

Column 7, claim 1, line 65, "ember" should be --member--;

Column 8, claim 1, line 4, "operable" should be --mounted--;

Column 8, claim 1, line 9, "operable" should be --mounted--; and

UNITED STATES PATENT AND TRADEMARK OFFICE

CERTIFICATE OF CORRECTION

PATENT NO. : 5,161,941

DATED : November 10, 1992

INVENTOR(S) : David A. Ratner

It is certified that error appears in the above-indentified patent and that said Letters Patent is hereby corrected as shown below:

Column 2, line 18, "intenral" should be --internal--;

Column 3, line 9, "unimpded" should be --unimpeded--;

Column 3, line 55, "links and" should be --links 80 and--;

Column 4, line 13, "into the between the trunnion" should be --into the trunnion--;

Column 4, line 17, "plate, 112." should be --plate 112.--;

Column 4, line 30, "ann" should be --an--;

Column 4, line 47, "to" should be --so--;

Column 5, line 1, "produced the" should be --produced by--;

Column 5, line 11, "acting a right" should be --acting at right--;

UNITED STATES PATENT AND TRADEMARK OFFICE

CERTIFICATE OF CORRECTION

PATENT NO. : 5,161,941

DATED : November 10, 1992

INVENTOR(S) : David A. Ratner

It is certified that error appears in the above-indentified patent and that said Letters Patent is hereby corrected as shown below:

Column 8, claim 2, line 15, "firs" should be --first--.

Signed and Sealed this

Eighth Day of March, 1994

Bruce Lehman

*Attest:*

BRUCE LEHMAN

*Attesting Officer*

*Commissioner of Patents and Trademarks*